US006371418B1

(12) United States Patent
Oswald et al.

(10) Patent No.: US 6,371,418 B1
(45) Date of Patent: Apr. 16, 2002

(54) CURVE PATH OF A SWITCH, AND TRACK JOINT USING THIS TYPE OF CURVE PATH

(75) Inventors: Johannes Rainer Oswald, Zeltweg; Hannes Gsodam, Reichenfels, both of (AT); Peter Ernst Klauser, Silverthorne, CO (US)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 09/331,452

(22) PCT Filed: Dec. 12, 1997

(86) PCT No.: PCT/AT97/00276

§ 371 Date: Jun. 21, 1999

§ 102(e) Date: Jun. 21, 1999

(87) PCT Pub. No.: WO98/28492

PCT Pub. Date: Jul. 2, 1998

(30) Foreign Application Priority Data

Dec. 23, 1996 (AT) ..... 2254/96

(51) Int. Cl.[7] ..... E01B 7/00

(52) U.S. Cl. ..... 246/415 R; 246/382

(58) Field of Search ..... 246/276, 382, 246/385, 387, 389, 392, 435 R, 438, 442, 443, 444, 415 R; 104/130.04, 130.06, 130.11

(56) References Cited

U.S. PATENT DOCUMENTS 3,745,336 A * 7/1973 Dohse et al. ..... 246/442
4,948,073 A * 8/1990 Edwards et al. ..... 246/415 A
5,292,091 A * 3/1994 Callegari et al. ..... 246/258
5,375,797 A * 12/1994 Willow ..... 246/415 R
5,499,583 A * 3/1996 Blumel ..... 104/130.03

FOREIGN PATENT DOCUMENTS

| | | | |
|---|---|---|---|
| DE | WO-95/31604 | * | 5/1995 |
| GB | 2199606 A | * | 12/1986 |
| GB | 2 199 606 | | 7/1988 |
| WO | 95/31604 | | 11/1995 |

OTHER PUBLICATIONS

Holzinger Und Fritz: "Entwicklung moderner Hochleistungsweichen zur Wahrung der Zukunftschancen der Bahn" ETR, Bd.39,Nr.1/2,1990, DARMSTADT, Seiten 71–78, XP002061773 in der Anmeldung erwahnt siehe das ganze Dokument.

* cited by examiner

*Primary Examiner*—S. Joseph Morano
*Assistant Examiner*—Frantz F. Jules
(74) *Attorney, Agent, or Firm*—Kevin E. Joyce

(57) ABSTRACT

The invention relates to a curve path of a switch comprising switch tongues, a main track and a branch track, which curve path from the beginning of the curve path to the end of the curve path is comprised of several portions having different curvatures 1/R, R being the radius of curvature, wherein the coefficient of curvature $\alpha=1/R/1/R_{min}$ at the beginning of the curve path ($\alpha_A$) and at the end of the curve path ($\alpha_E$) is selected to be $\geqq 0$ and the point, or a region, in which $\alpha=1$ is located at a relative distance $\nu=L/L_{ges}\neq 0.5$ from the beginning of the curve path, L being the distance from the beginning of the curve path and $L_{ges}$ being the length of the curve path.

11 Claims, 4 Drawing Sheets

CURVE PATH OF A SWITCH, AND TRACK JOINT USING THIS TYPE OF CURVE PATH

This application is the national phase of international application PCT/AT97/00276 filed Dec. 12, 1997 which designated the U.S.

BACKGROUND OF THE INVENTION

1. Field of the Invention

The invention relates to a curve path of a switch comprising switch tongues, a main track and a branch track, which curve path from the beginning of the curve path to the end of the curve path is comprised of several portions having different curvatures 1/R, R being the radius of curvature.

2. Prior Art

From the article in ETR 39 (1990), H.1/2, January/February, by Reimar Holzinger and Dieter Fritz, "Entwicklung moderner Hochleistungsweichen zur Wahrung der Zukunftschancen der Bahn", a number of switch geometries have become known for meeting the demands of high-speed traffic, which, as a rule, are characterized by a high degree of symmetry in order to prevent sudden changes in direction or curvature of the track and hence excessive transverse accelerations. The considerations made in that article relate to transition curves of the clothoid and cosine parabola types and sinus transition curves, changes in acceleration (jerks) being contemplated in detail.

From WO 95/31604 a curve path for the course of rails from the main track to a branch track can be taken, in which, likewise departing from a first end portion starting with a radius of curvature towards infinity, the respectively other end of the switch is again configured with a radius ending towards infinity in order to avoid additional vibratory excitations that may have adverse effects on vehicles. In that known configuration, a curve path comprised of three portions has been chosen, three approximately equally long portions being used. Departing from a curvature having a radius of curvature tending towards infinity, a central portion having a constant curvature whose radius constitutes a minimum over the curve path is chosen. In the main, this results in the course of two conventional clothoids having an intermediate portion in the form of a circular arc.

SUMMARY OF THE INVENTION

The invention aims at providing a curve path of the initially defined kind, which entails less wear of the structural components and hence higher service lives as well as lower overall costs, in particular in high-speed operation. At the same time, the invention aims to improve the maintenance expenditures and travelling comfort of such switches, in particular high-speed switches. To solve this object, the curve path of a switch according to the invention essentially consists in that the coefficient of curvature $\alpha=1/R/1/R_{min}$ at the beginning of the curve path ($\alpha_A$) and at the end of the curve path ($\alpha_E$) is selected to be $\geqq 0$ and that the point, or a region, in which $\alpha=1$ is located at a relative distance $\nu=L/L_{ges}\neq 0.5$ from the beginning of the curve path, L being the distance from the beginning of the curve path and $L_{ges}$ being the length of the curve path. The curvature 1/R serves to define a dimensionless coefficient of curvature $\alpha$, which equals the quotient of the instantaneous curvature 1/R and the maximum curvature $1/R_{min}$, the maximum curvature, in turn, resulting from the quotient of 1 and the minimum radius. $\alpha$can, thus, assume values of between 0 and 1, hence the radius is tending towards infinity in points in which $\alpha$ equals zero, since the minimum radius has a finite value. In the point of maximum curvature, and hence of minimum radius, this coefficient $\alpha$ assumes the value 1. In addition to defining the value $\alpha$, also a coefficient $\nu$ is defined, which sets the respective distance between the beginning of the curve path and the curve path point considered in relation to the total length of the curve path. The value $\nu$, thus, equals zero at the beginning of the curve path and 1 at the end of the curve path, assuming any values of between 0 and 1 in direct proportion to the distance from the beginning of the curve path. Investigations into vehicle movement dynamics, under consideration of the usual course of cross sectional changes of the structural elements concerned, such as, e.g., tongue and nose of crossing, have now proved that, by turning away from the usual symmetry in the structure of such curve paths, it is feasible to both reduce wear and enhance comfort by the point or region with $\alpha=1$ being located at a relative distance $\nu\neq 0.5$ from the beginning of the curve path.

It has now been shown that the curve path geometry may be further optimized to the extent that the moving direction in which the switch is usually travelled over is also taken up into geometry considerations. With a particular advantage, $\alpha_A$ and $\alpha_E$ are selected between 0 and 0.5 and $\nu_{max}$ for $\alpha_{max}$ between 0.45 and 0.8 and unequal to 0.5 for a bidirectionally passed switch. A bidirectionally passed switch means that the switch is travelled over both facing and trailing. A switch travelled over primarily in one direction in a particularly advantageous manner is designed such that, for a switch passed facing, $\alpha_A$ is selected between 0 and 0.5, $\alpha_E$ is selected between 0.5 and 1 and $\nu$ for $\alpha_{max}$ is selected between 0.4 and 1 and unequal to 0.5 and that, for a switch passed trailing, $\alpha_A$ is selected between 0.3 and 0.7, $\alpha_E$ is selected between 0 and 0.5 and $\nu$ for $\alpha_{max}$ is selected between 0.3 and <0.5. The values indicated above for the different curve path geometries for different travelling directions have been optimized in terms of minimum lateral accelerations and running-in jerks as well as slight wear phenomena and small wheel-rail forces. A slight lateral acceleration and break-in jerk thereby guarantee a high comfort in passing the switch, little wear and small wheel-rail forces render feasible a long service life of the switch.

In a particularly advantageous manner, the configuration according to the invention is devised such that one, and only one, point of maximum curvature or minimum radius with $\nu\neq 0.5$ is provided between the beginning of the curve path and the end of the curve path. Here again, the turning away from the hitherto chosen symmetry as suggested, for instance, in WO 95/31604, brings about a substantial improvement in comfort and a reduced wear. If one, and only one, point of maximum curvature is provided, the curve path geometry may have the form of a vertex clothoid in the curved course, wherein $\nu$ will assume a value of $\neq 0.5$ in accordance with the definition chosen above, if such a vertex clothoid is used. In the case of cosinoids, it is known to select different values $\alpha$ at the beginning of the curve path and at the end of the curve path, wherein it has hitherto been common also in that case to select the value $\alpha$ at the end of the curve path to be 0 and, thus, progressively merging into the connection rail. If, as in accordance with a preferred further development of the invention, an intermediate region is chosen instead of one, and only one, point of maximum curvature, the configuration advantageously is devised such that a portion of constant maximum curvature is arranged between the beginning of the curve path and the end of the curve path, wherein the radius constitutes a minimum and whose center is arranged outside the center between the beginning of the curve path and the end of the curve path, the symmetry considerations made so far again having been left in the instant case. The central region of such a circular arc portion, like the previously mentioned one, and only one, point of maximum curvature, is not located in the longitudinal center of the curve path, thereby offering improvements in terms of wear and moving comfort.

In a particularly simple manner, the configuration is devised such that the portions differing from the shape of a circular arc are formed by clothoids and/or cosinoids. If, as already pointed out above, the travelling direction is additionally taken up into the switch geometry considerations, the curve path geometry in a particularly advantageous manner is defined such that, with a switch passed facing, the point of maximum curvature is arranged at the end of the curve path. In case of vertex clothoids and cosinoids, one, and only one, point of maximum curvature is usually observed, wherein in those cases the configuraton is devised such that the point of maximum curvature is arranged closer to the beginning of the curve path with vertex clothoids or cosinoids, in particular when trailing a switch.

As already mentioned in the beginning, the curve path according to the invention is suitable, in particular, for the construction of track connections aimed to be passed at high speeds. A track connection according to the invention using switches of the initially defined kind travelled over in both directions preferably is designed in a manner that the curve path ends merge into a straight-line connecting portion with $\alpha_E$ ranging between 0 and 0.5. The track connection in a particularly preferred manner is devised such that the straight-line portion has a length of from 5 to 30% of the total length $L_{ges}$ of a curve path. This straight-line connecting portion at a ratio of 5 to 30% of the total length of a curve path provides for a substantially enhanced steadiness of the run of the vehicle.

The switch geometries according to the invention, thus, are primarily applicable to track connections travelled over at high speeds, whereby the combination of different switch geometries according to the invention, as defined above, guarantees a substantially reduced wear and a substantially enhanced service life.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
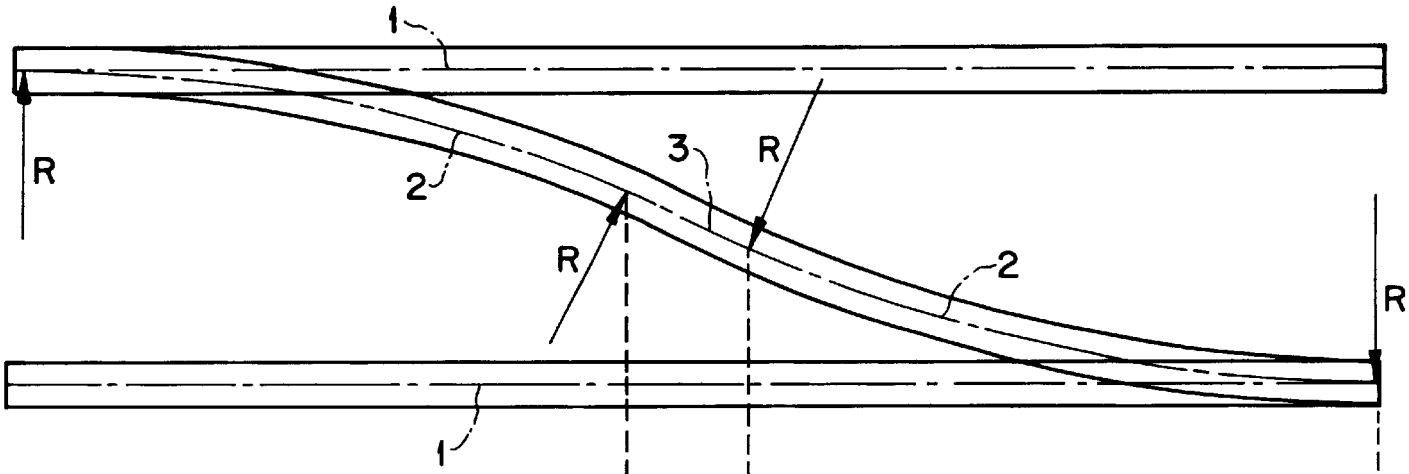
FIG. 1 is a schematic top view on a conventional track connection in which two branch tracks merge into a substantially straight-line intermediate portion, applying a constant radius of curvature.
Figure 2:
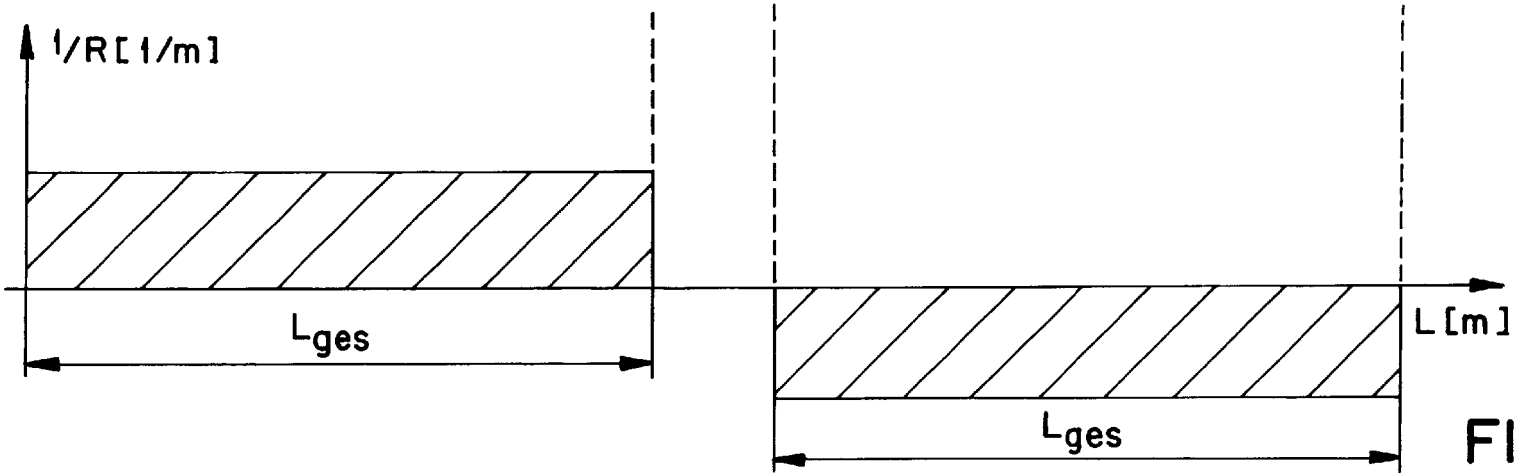
FIG. 2 depicts the pertinent diagram, in which the curvature 1/R has been plotted over the length L of the track connection.

FIG. 1, the main track is each denoted by 1, the length of the respective curve path being denoted by $L_{ges}$ in the representation according to FIG. 2. In the embodiment according to FIGS. 1 and 2, a conventional curve path geometry according to the prior art is shown, branch ducts 2 branching off at constant radii and merging into a straight-line central portion 3. The change in curvature 1/R over the length L of the track connection is immediately apparent from FIG. 2.

Figure 3:
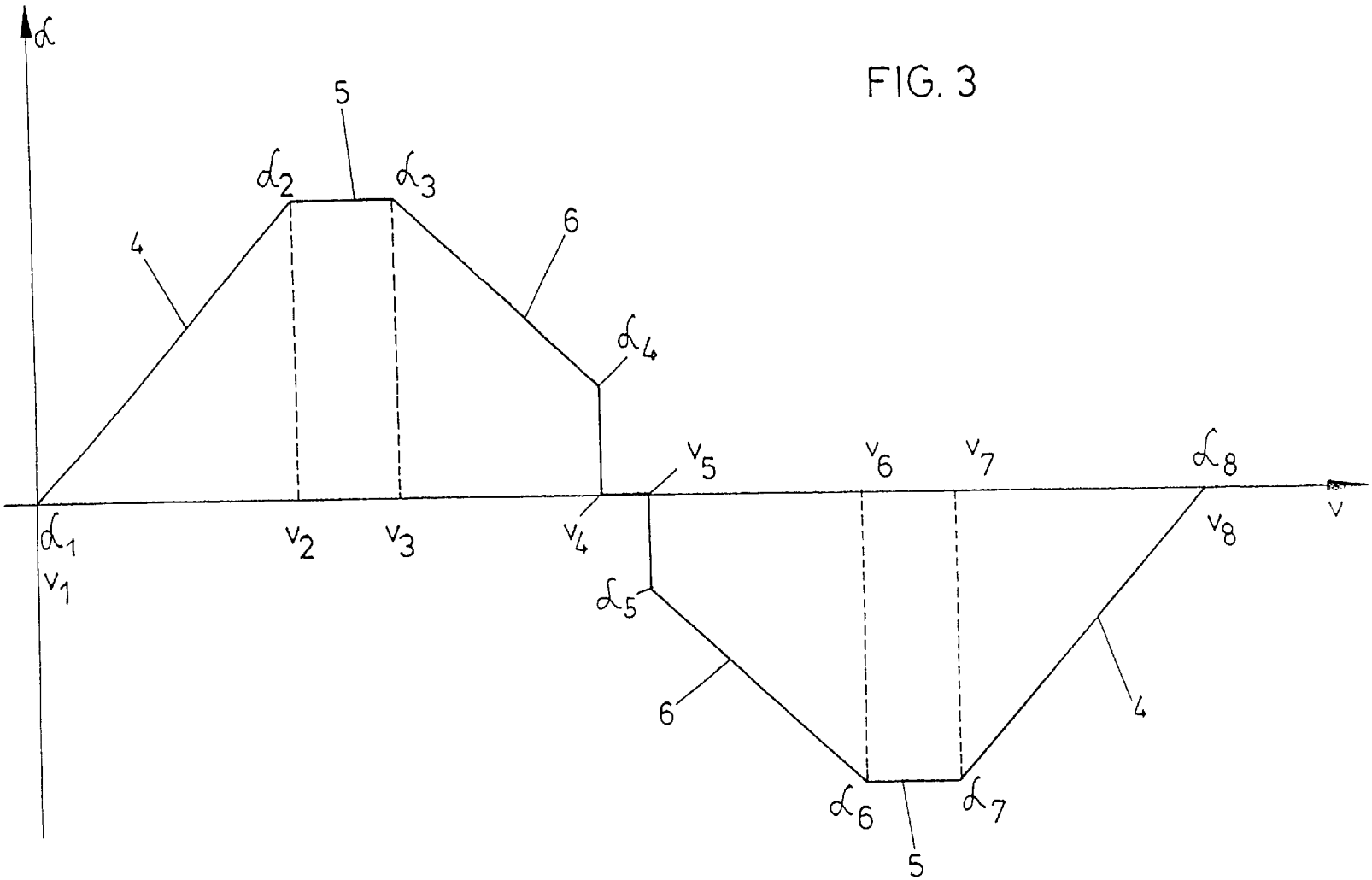
In FIG. 3, instead of the curvature 1/R, the dimensionless coefficient of curvature $\alpha$ has been plotted over the length of a track connection having the curve paths according to the invention.

In the embodiment according to FIG. 3, a switch connection travelled over in both directions is schematically represented in an illustration analogous to that of FIG. 2, using the definition of $\alpha$ instead of the curvature 1/R. Within the single curve path, there was each arranged a clothoid between the length portions $\nu_1$ to $\nu_2$, a circular arc between $\nu_2$ and $\nu_3$, and a further clothoid between $\nu_3$ and $\nu_4$, the straight-line portion of the track connection being arranged between and $\nu_4$ and $\nu_5$. From this illustration, it is apparent that the first clothoid-shaped partial region, which is characterized by a linear rise of the value $\alpha$ from $\alpha_1$ to $\alpha_2$ and denoted by 4, merges into a circular arc portion 5 in the point $\nu_2$ at a maximum curvature and hence minimum radius of curvature, the length of which circular arc portion extends from $\nu_2$ to $\nu_3$. The values $\alpha_2$ and $\alpha_3$, respectively, equal 1 by definition, whereupon the curve path subsequently merges into a clothoid 6 terminating by $\alpha_4 \neq \alpha_1$ and $\neq 0$. At the end of the first curve path, which is defined by point $\nu_4$, the proportional number $\alpha$ has a value of approximately 0.2 to 0.3 in the exemplary embodiment chosen, the straight-line portion extending as far as to the end of the second curve path at $\nu_5$. On that site, the trailingly passed clothoid was again formed with $\alpha_5 \neq 0$ such that a discrete transition into the curve path of the subsequent switch occurs also in that case. In the main, the second switch of that switch connection equals the asymmetrically structured first switch in terms of axial symmetry such that in the entry region a clothoid 6 and, following upon $\nu_6$, a circular arc portion 5 running into a clothoid 4 are again provided. The beginning of the curve path of this switch connection travelled over in both direction at a high speed again has a radius of curvature tending towards infinity such that $\alpha_8 = \alpha_1 = 0$ in the point $\nu_8$. The regions located therebetween have each been denoted by consecutive indices. For this configuration of a switch connection capable of being passed in both directions at a high speed, thus, applies that the value of $\alpha_4$ has been chosen to equal the value of $\alpha_5 \neq 0$, whereas the two switch beginnings of the switch connection at $\alpha_1$ and $\alpha_8$ assume the value $\alpha = 0$.

Figure 4:
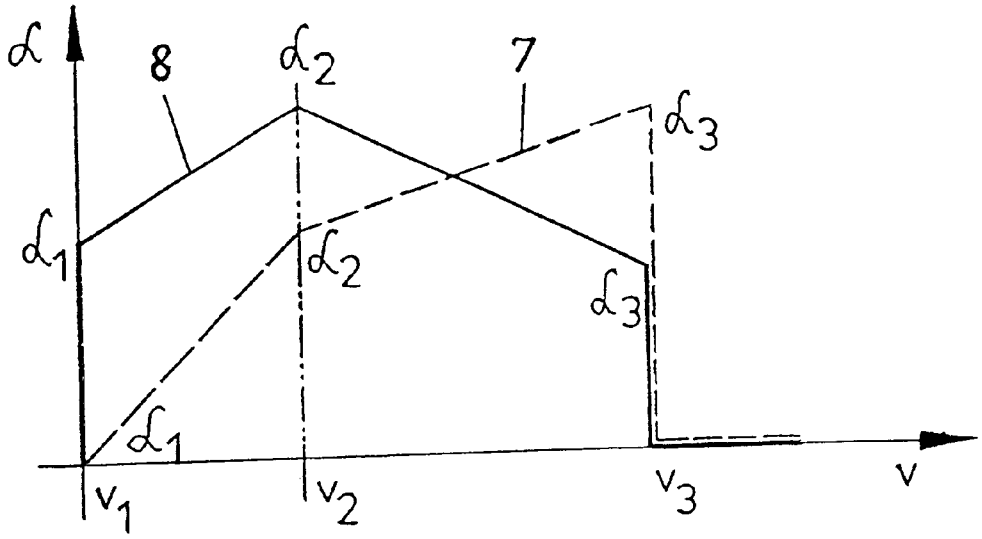
FIG. 4 depicts a single switch geometry of a vertex clothoid with $\alpha$ having been plotted against $\nu$ and FIG. 5 is an analogous illustration for a cosinoid, and FIGS. 6 to 8 indicate the values for specific switch configurations.
Figure 5:
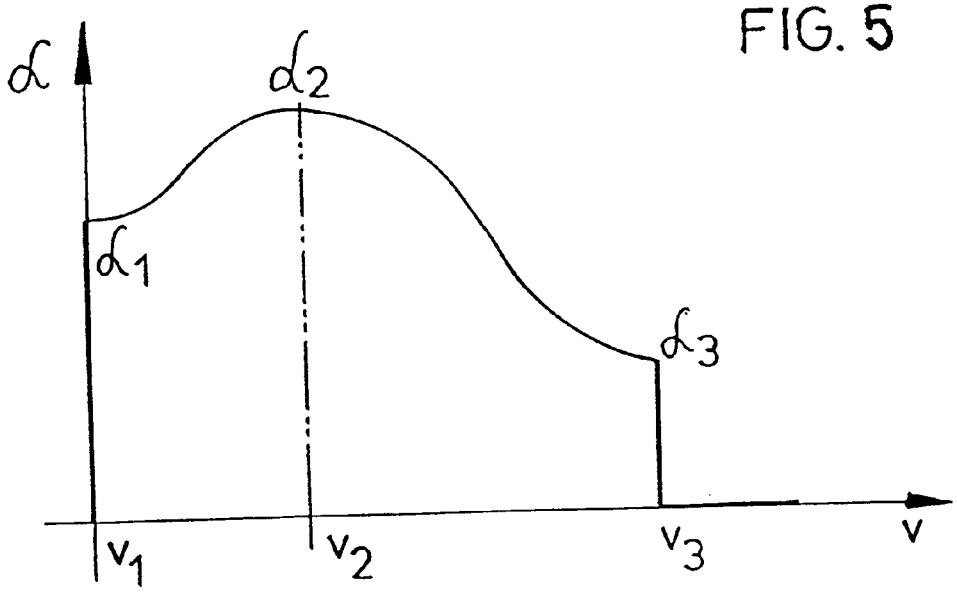

FIGS. 4 and 5 in detail depict other forms of single switches, FIG. 4 illustrating two vertex clothoids 7 and 8. The vertex clothoid 7 for the facing passage has its maximum curvature or maximum $\alpha$ in point $\nu_3$, the value here having been denoted by $\alpha_3$. The clothoid itself again is asymmetrically designed, the course of 1/R in point $\nu_2$ having a kink. With a vertex clothoid as indicated by 8 in FIG. 4, which is particularly advantageous when trailing a switch, $\alpha_1 \neq 0$ is selected as opposed to the configuration in the facing passage. With that vertex clothoid geometry, which is particularly advantageous when passing a switch trailing, $\alpha$ rises as far as to point $\nu_2$, reaching the maximum $\alpha_2$ closer to the trailingly passed curve path beginning. $\alpha_3$ in point $\nu_3$ again is selected to be greater than 0 and unequal to $\alpha_1$ in point $\nu_1$. With the switch geometry of a cosinoid illustrated in FIG. 5, $\alpha_1$ in point $\nu_1$ is >0, passing a maximum having the value $\alpha_2$ in point $\nu_2$. The change in the curve radius continues as far as to point $\nu_3$ on the cosinoid end facing away from the tongue, where $\nu_3$ assumes a value that differs from $\alpha_1$ and 0. $\nu_2$ again is located eccentrically between $\nu_1$ and $\nu_3$, thus providing for the desired effects in terms of wear reduction and comfort enhancement.

Figure 6:
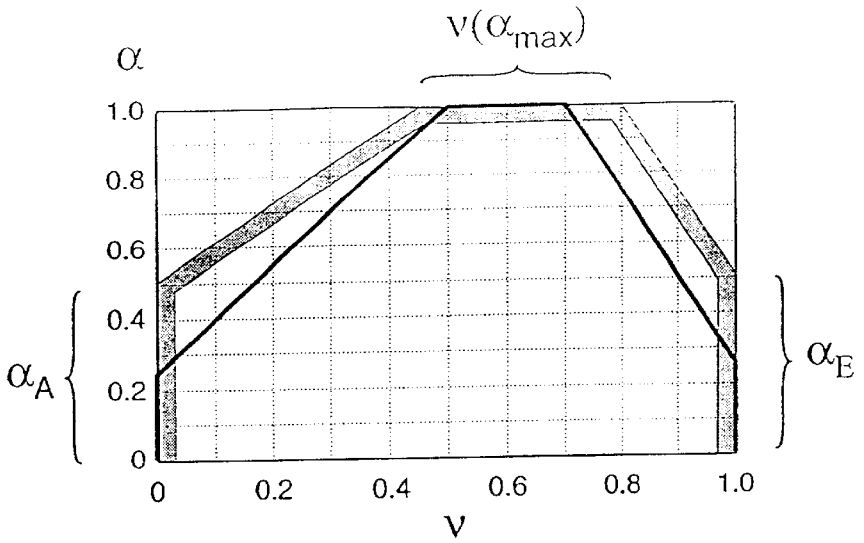
Figure 7:
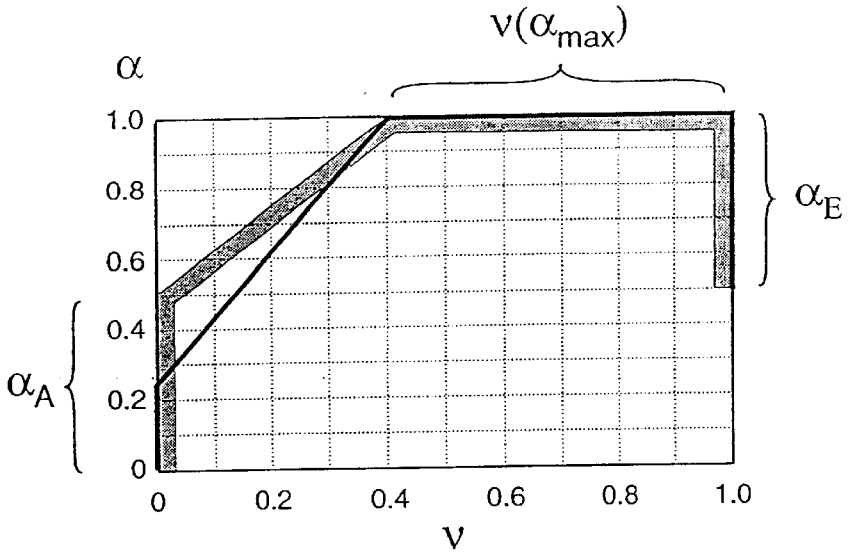
Figure 8:
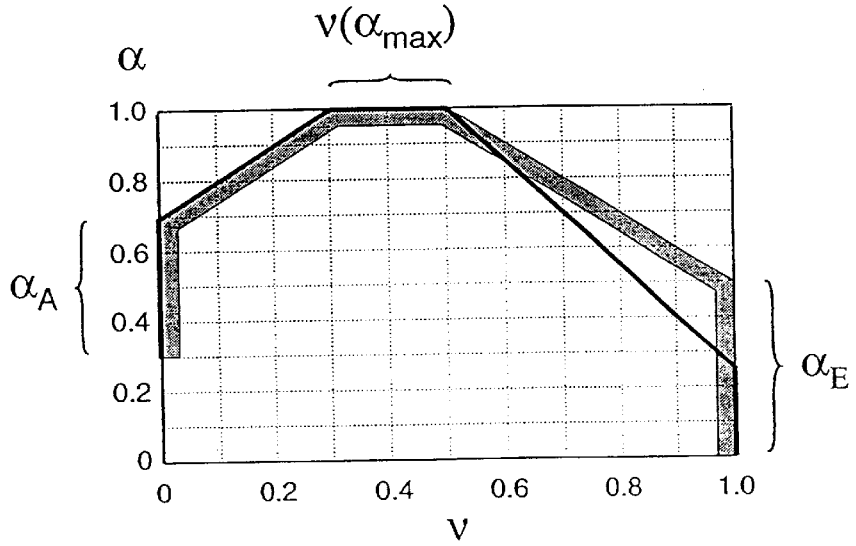

The optimum switch geometries are plotted in FIG. 6 for a switch passed in both directions, in FIG. 7 for a switch passed facing and in FIG. 8 for a switch passed trailing. $\alpha_A$ denotes the coefficient of curvature at the beginning of the curve path, $\alpha_E$ the coefficient of curvature at the end of the curve path and $\nu$ ($\alpha_{max}$) the regions of maximum curvature with $\alpha=1$. The hatched line defines the region supposed to be more readily realizable in terms of practical feasibility. The full line determines the optimum region of solution.

In the following, examples of the curve path geometry will be indicated for different travelling directions, which are optimized with regard to minimum lateral accelerations and running-in jerks at wear phenomena and wheel-rail forces as slight as possible, and hence with regard to the highest comfort possible and a maximum service life. Hence, for a bidirectionally passed curve path of a switch, there results an optimized solution for a vertex clothoid geometry, wherein $$\alpha_A=0.05$$

$$\alpha_E=0$$

$$\nu(\alpha_{max})=0.6.$$

For a curve path of a switch passed facing, there results an optimized solution for a clothoid-circular arc-clothoid geometry, wherein $$\alpha_A=0.1$$

$$\alpha_E=0.65$$

$$\nu(\alpha_{max})=0.5 \text{ to } 0.7.$$

For a curve path of a switch passed trailing, there results an optimized solution for a vertex clothoid geometry, wherein $$\alpha_A=0.5$$

$$\alpha_E=0$$

$$\nu(\alpha_{max})=0.35.$$

At speeds of $\geqq 160$ km/h, for the optimum track connection comprising two bidirectionally passed curve paths, there results an optimized solution for a vertex clothoid geometry, wherein $$\alpha_{A1}=\alpha_{A2}=0.05$$

$$\alpha_{E1}=\alpha_{E2}=0$$

$$\nu(\alpha_{max})=0.6$$

and the length of the connecting portion=5% of the curve path $L_{ges}$.

What is claimed is:

1. A curve path of a switch comprising switch tongues, a main track and a branch track, which curve path from a beginning of a curve path to an end of the curve path is comprised of several portions having different curvatures 1/R, R being a radius of curvature, wherein a coefficient of curvature $\alpha=1/R/1/R_{min}$ at the beginning of the curve path ($\alpha_A$) and at the end of the curve path ($\alpha_E$) is selected to be $\geqq 0$ and wherein a point, or a region, in which $\alpha=1$ is located at a relative distance $\nu=L/L_{ges}\neq 0.5$ from the beginning of the curve path, L being the distance from the beginning of the curve path and $L_{ges}$ being the length of the curve path.

2. A curve path according to claim 1, wherein for a bidirectionally passed switch, a coefficient of curvature for maximum curvature ($\alpha_{max}$) is selected between 0.45 and 0.8 and unequal to 0.5.

3. A curve path according to claim 1, wherein for a switch passed from a direction facing the switch, $\alpha_A$ is selected between 0 and 0.5, $\alpha_E$ is selected between 0.5 and 1 and $\nu$ for a coefficient of curvature for maximum curvature ($\alpha_{max}$) is selected between 0.4 and 1 and unequal to 0.5.

4. A curve path according to claim 1, wherein for a switch passed from a direction trailing the switch, $\alpha_A$ is selected between 0.3 and 0.7, $\alpha_E$ is selected between 0 and 0.5 and $\nu$ for a coefficient of curvature for maximum curvature ($\alpha_{max}$) is selected between 0.3 and <0.5.

5. A curve path according to any one of claims 1 to 4, wherein a single point of maximum curvature or minimum radius with $\nu\neq 0.5$ is provided between the beginning of the curve path and the end of the curve path.

6. A curve path according to any one of claims 1 to 4, wherein a portion of constant maximum curvature is arranged between the beginning of the curve path and the end of the curve path, and wherein the radius constitutes a minimum and whose center is arranged outside a center between the beginning of the curve path and the end of the curve path.

7. A curve path according to any one of claims 1 to 4, wherein portions differing from circular arc shape are formed by clothoids and/or cosinoids.

8. A curve path according to claim 3, wherein a point of maximum curvature is arranged closer to the end of the curve path.

9. A curve path according to claim 7, wherein with vertex clothoids or cosinoids, a point of maximum curvature is arranged closer to the beginning of the curve path.

10. A plurality of curve paths according to any one of claims 1 to 4, wherein respective curve path ends merge into a straight-line connecting portion with $\alpha_E$ ranging between 0 and 0.5 to form a switch connection.

11. A plurality of curve paths according to claim 10, wherein the straight-line portion has a length of from 5 to 30% of the total length $L_{ges}$ of a curve path.

* * * * *